US009932660B2

(12) United States Patent
Saito et al.

(10) Patent No.: US 9,932,660 B2
(45) Date of Patent: Apr. 3, 2018

(54) METHOD FOR DEPOSITING LAYER

(71) Applicant: MITSUBISHI HEAVY INDUSTRIES, LTD., Tokyo (JP)

(72) Inventors: Makoto Saito, Tokyo (JP); Noriyuki Hiramatsu, Tokyo (JP); Akira Fukushima, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 14/765,122

(22) PCT Filed: May 20, 2013

(86) PCT No.: PCT/JP2013/063901
§ 371 (c)(1),
(2) Date: Jul. 31, 2015

(87) PCT Pub. No.: WO2014/128984
PCT Pub. Date: Aug. 28, 2014

(65) Prior Publication Data

US 2015/0376762 A1 Dec. 31, 2015

(30) Foreign Application Priority Data

Feb. 19, 2013 (JP) ..... 2013-030378

(51) Int. Cl.
*C23C 4/06* (2016.01)
*C23C 4/12* (2016.01)
(Continued)

(52) U.S. Cl.
CPC ..... *C23C 4/128* (2013.01); *C23C 4/06* (2013.01); *C23C 4/18* (2013.01); *C23C 24/04* (2013.01)

(58) Field of Classification Search
None
See application file for complete search history.

(56) References Cited

U.S. PATENT DOCUMENTS

2006/0121187 A1 6/2006 Haynes et al.
2006/0269685 A1 11/2006 Raybould et al.
2010/0170937 A1* 7/2010 Calla ..... C23C 24/04 228/165

FOREIGN PATENT DOCUMENTS

JP 2006-161161 6/2006
JP 2008-127676 6/2008
(Continued)

OTHER PUBLICATIONS

International Preliminary Report on Patentability dated Sep. 3, 2015 in corresponding International Application No. PCT/JP2013/063901.
(Continued)

*Primary Examiner* — Shamim Ahmed
*Assistant Examiner* — Bradford Gates
(74) *Attorney, Agent, or Firm* — Wenderoth, Lind & Ponack, L.L.P.

(57) ABSTRACT

A method for depositing a layer includes repeatedly performing a unit deposition process until the layer on a deposition target reaches a predetermined thickness. The unit deposition process includes (A) placing the deposition target in a chamber, (B) providing a non-oxidizing gas atmosphere or a vacuum atmosphere in the chamber, (C) depositing the layer on the deposition target by a cold spray process in the non-oxidizing gas atmosphere or the vacuum atmosphere, and (D) heat treating the deposition target after the depositing.

5 Claims, 10 Drawing Sheets

(51) Int. Cl.
*C23C 24/04* (2006.01)
*C23C 4/18* (2006.01)

(56) References Cited

FOREIGN PATENT DOCUMENTS

| | | |
|---|---|---|
| JP | 2009-191349 | 8/2009 |
| JP | 2010-47825 | 3/2010 |
| JP | 2012-57203 | 3/2012 |
| JP | 5017675 | 9/2012 |

OTHER PUBLICATIONS

International Preliminary Report on Patentability dated Sep. 3, 2015 in related International Application No. PCT/JP2013/063896.
International Search Report dated Jun. 11, 2013 in International Application No. PCT/JP2013/063896.
International Search Report dated Jun. 11, 2013 in International Application No. PCT/JP2013/063901.
Decision to Grant a Patent dated Nov. 14, 2016 in corresponding Japanese Application No. 2013-030378, with English translation.
U.S. Office Action dated May 4, 2017 issued in U.S. Appl. No. 14/764,766.

* cited by examiner

METHOD FOR DEPOSITING LAYER

CROSS-REFERENCE TO RELATED APPLICATION

This application claims priority from Japanese Patent Application No. JP 2013-030378 filed on Feb. 19, 2013, the disclosure of which is hereby incorporated by reference herein in its entirety.

TECHNICAL FIELD

The present invention relates to a method for depositing a layer using cold spraying.

BACKGROUND ART

There is a case in which it is necessary to form a thick layer on a base member to manufacture a structure. Such a structure is, for example, a combustion chamber of a space rocket engine or an aerospace rocket engine. When the combustion chamber of the rocket engine is manufactured, it is necessary, for example, to form a copper layer having a thickness of 10 mm or more on the base member formed of copper.

One method for forming such a thick metal layer is "electroplating". However, a layer growth rate using electroplating is extremely slow. For example, it takes several months to reach a target layer thickness of about 10 mm.

To solve the above-mentioned problem, the applicant of this application proposed a technique in which the thick metal layer is deposited using a "cold spray process" in Japanese Patent Application Publication JP 2012-057203 A. The cold spray process is a process in which a high-speed gas flow having a temperature lower than a melting point or softening point of material powder is formed, the material particles are supplied in the high-speed gas flow and are accelerated, and the material particles in a solid state are impinged on the base member to form the layer. The layer growth rate using this cold spray process is extremely fast as compared to the case of electroplating. Therefore, it is possible to reduce a period required for manufacturing the structure by using the cold spray process.

However, unlike the case such as forming a thin oxide layer by cold spraying, when the thick layer of about 10 mm is formed by cold spraying, it is necessary to consider a following point. The point is that, when a formed layer reaches a certain degree of thickness, residual stress becomes stronger than adhesion strength and separation of the formed layer occurs. A limit whether or not the separation of the formed layer occurs is hereinafter referred to as a "separation limit". In order to prevent the separation of the formed layer, it is necessary to remove the residual stress by heat treatment before reaching the separation limit as described in Japanese Patent Application Publication JP 2012-057203 A.

FIG. 1 schematically indicates a relationship between the thickness of the formed layer and the residual stress (internal stress). As shown in FIG. 1, in the case of forming the layer by cold spraying, the layer thickness increases with time, and accordingly, the residual stress also increases with the time. If the residual stress exceeds a separation limit line, the formed layer separates. Therefore, a layer deposition process by cold spraying is once stopped before that. Then, "heat treatment" is performed separately from the cold spray. By this heat treatment, the residual stress of the formed layer is removed. After that, the layer deposition process by cold spraying is restarted.

Thus, in order to form the thick layer of about 10 mm by cold spraying, it is necessary to repeatedly perform the layer deposition process and the heat treatment process. A unit of the processes, which is repeatedly performed, is referred to as a "unit deposition process". The unit deposition process includes (1) a step of depositing the layer by cold spraying under conditions in which the residual stress does not exceed the separation limit line and (2) a step of performing the heat treatment so that the residual stress is removed.

As other techniques related to the cold spray, the following techniques are known.

Japanese Patent No. 5,017,675 discloses a method of forming a film of about 400 μm thickness by a cold spray process. The method includes (A) a step of decreasing or removing an oxide formed on a surface of raw material powder, which is metal powder having a surface on which the oxide is formed, by hydrogen reduction treatment or acid cleaning treatment and (B) a step of colliding the raw material powder, from which the oxide has been decreased or removed, with an object to be coated by the cold spray process to form the film thereon.

Japanese Patent Application Publication JP 2010-047825 A discloses a method of forming a coating of about 1.5 mm by the cold spray process. The method includes a step of forming a metal coating on a surface of base material by projecting non-spherical heteromorphous particles made of metal onto the base material surface by the cold spray process.

SUMMARY OF THE INVENTION

The inventors of this application have recognized the following points. As described above, in order to form the thick layer using the cold spray process, it is necessary to perform the heat treatment during performing the layer deposition method. However, as the number of the heat treatment increases, the layer deposition time also increases as a whole. It is not only because the heat treatment itself requires a certain amount of time, but also because it is necessary to stop a cold spray apparatus every time of heat treating and it is necessary to restart and adjust the cold spray apparatus every time of restarting the layer deposition process. That is, as the number of the heat treatment increases, layer deposition costs increase. Therefore, the fewer the number of the heat treatment (the unit deposition process), the better.

One object of the present invention is to provide a technique with which it is possible to reduce the number of the heat treatment (the unit deposition process) in depositing a thick layer using cold spraying.

In one aspect of the present invention, a method for depositing a layer is provided. The method includes a step of repeatedly performing a unit deposition process until the layer on a deposition target reaches a predetermined thickness. The unit deposition process includes (A) placing the deposition target in a chamber, (B) providing a non-oxidizing gas atmosphere or a vacuum atmosphere in the chamber, (C) depositing the layer on the deposition target by a cold spray process in the non-oxidizing gas atmosphere or the vacuum atmosphere, and (D) heat treating the deposition target after the depositing.

In another aspect of the present invention, a method for depositing a layer is provided. The method includes (a) placing a deposition target in a chamber, (b) providing a non-oxidizing gas atmosphere or a vacuum atmosphere in the chamber, (c) depositing the layer on the deposition target by a cold spray process in the non-oxidizing gas atmosphere or the vacuum atmosphere to form the layer having a thickness of 1 mm or more on the deposition target.

According to the present invention, it is possible to reduce the number of the heat treatment (the unit deposition process) in depositing the thick layer using cold spraying. As a result, layer deposition costs can be reduced.

DESCRIPTION OF EMBODIMENTS

With reference to the accompanying drawings, a layer deposition technique according to some embodiments will be explained.

1. First Embodiment

Figure 1:
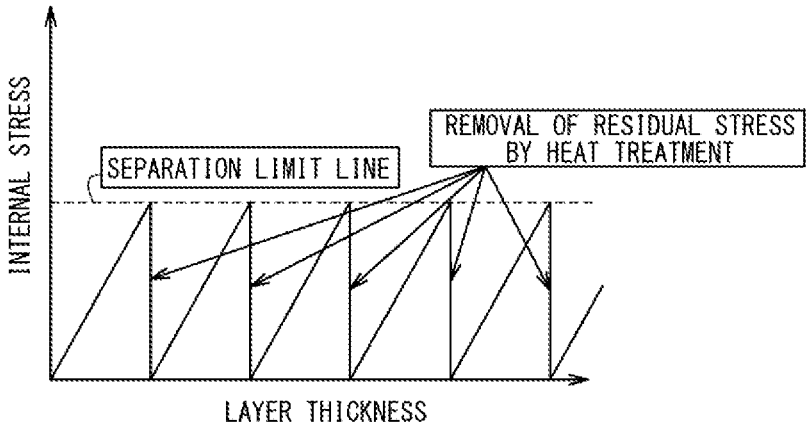
Fig. 1 PRIOR ART
FIG. 1 is a diagram for conceptually indicating a relationship between a thickness of a formed layer and a residual stress (an internal stress) in forming a thick layer by cold spraying.
Figure 2:
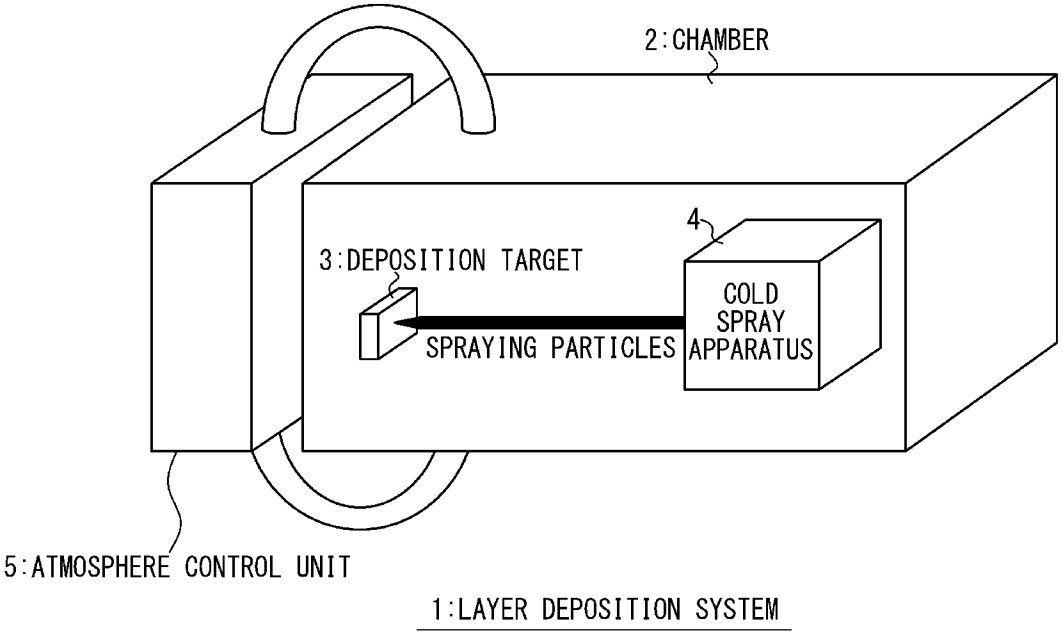
FIG. 2 is a schematic diagram for indicating a configuration of a layer deposition system according to the first embodiment.

FIG. 2 schematically indicates the configuration of the layer deposition system 1 according to the first embodiment. The layer deposition system 1 includes a chamber 2, a cold spray apparatus 4, and an atmosphere control unit 5. In the chamber 2 (layer deposition chamber), a deposition target 3 is arranged. The cold spray apparatus 4 is arranged so that it is possible to perform the layer deposition on the deposition target 3 using the cold spray process.

The atmosphere control unit 5 is arranged for controlling an atmosphere in the chamber 2. In the first embodiment, the atmosphere control unit 5 is a gas supply apparatus for supplying "non-oxidizing gas" into the chamber 2. The non-oxidizing gas is, for example, inert gas such as Ar and He, and nitrogen $N_2$.

Figure 3:
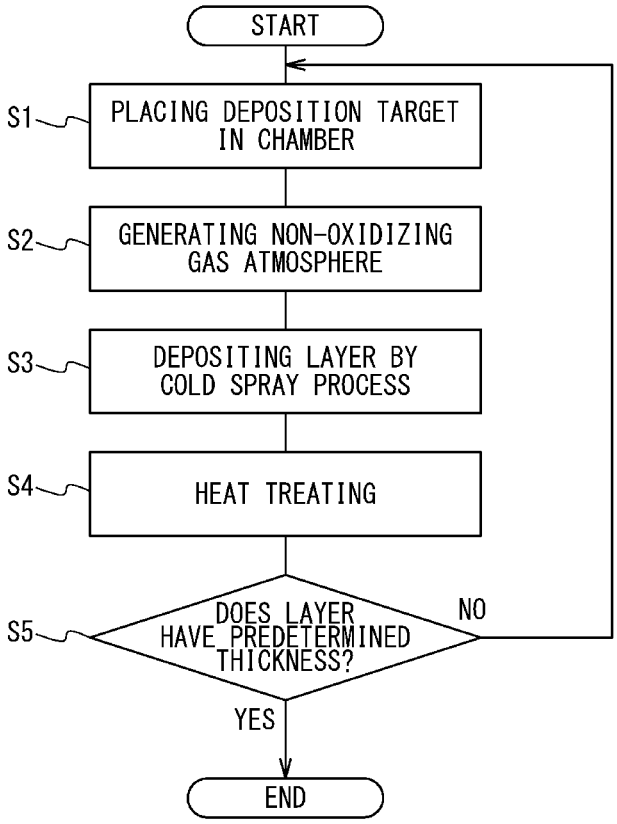
FIG. 3 is a flowchart for indicating a layer deposition method according to the first embodiment.

FIG. 3 is the flowchart for indicating the layer deposition method according to the first embodiment. Referring to FIG. 2 and FIG. 3, the layer deposition method according to the first embodiment will be explained.

Step S1:

At first, the deposition target 3 is placed in the chamber 2.

Step S2:

Subsequently, the atmosphere control unit 5 is activated to supply the non-oxidizing gas into the chamber 2. As a result, the atmosphere in the chamber 2 is set to a non-oxidizing gas atmosphere. The non-oxidizing gas is, for example, the inert gas such as Ar and He, and nitrogen $N_2$.

Step S3:

Next, the cold spray apparatus 4 is activated to deposit a layer on the deposition target 3 using a cold spray process. It should be noted that the layer deposition process is performed in the non-oxidizing gas atmosphere provided in the above-mentioned Step S2. Therefore, oxidation during the layer deposition process is prevented.

In the cold spray process, the layer deposition is performed by spraying material powder on a surface of the deposition target 3. When a structure such as a rocket engine combustion chamber is manufactured, typically, the deposition of a metal layer is performed by spraying metal material powder. For example, one example of conditions for cold spraying when a copper layer is to be formed by spraying copper powder is as follows.

Working gas for cold spraying: helium or nitrogen;

Supply rate of the copper powder: ranging from 20 g/min to 300 g/min;

Gas pressure: ranging from 2 MPa to 10 MPa; and

Temperature of the powder and working gas in a heating furnace before the deposition process: ranging from 200 degrees Celsius to 950 degrees Celsius.

By the way, as the formed layer becomes thicker, the residual stress of the formed layer also increases. To prevent occurrence of the separation of the formed layer caused by such a residual stress, the layer deposition process of one time using cold spraying is stopped before a thickness of the formed layer exceeds a layer thickness corresponding to the separation limit. Then, in order to remove the residual stress in the formed layer, heat treatment is performed as explained below.

Step S4:

After the layer deposition process of one time is completed, the deposition target 3 after the one deposition process is removed from the chamber 2, and is set in a heat treatment apparatus (not shown). Then, the heat treatment is performed on the deposition target 3. As a result, the residual stress of the formed layer is removed.

Step S5:

The above-mentioned Steps S1 to S4 correspond to the "unit deposition process". When one unit of the deposition process is completed, unless the thickness of the formed layer reaches a predetermined layer thickness (Step S5; No), it returns to Step S1. On the other hand, if the thickness of the formed layer reaches the predetermined layer thickness (Step S5; Yes), the whole process ends. That is, until the thickness of the formed layer on the deposition target 3 reaches the predetermined layer thickness, the unit deposition process is repeatedly performed.

In the case in which a manufacture of the structure rather than just a coat is considered, the predetermined layer thickness is typically 1 mm or more. In the case of manufacturing the rocket engine combustion chamber, the predetermined layer thickness is typically 10 mm or more. Even when such a thick layer is considered, it is possible to deposit the layer using the cold spray process by performing the heat treatment to remove the residual stress.

As explained above, according to the present embodiment, the layer deposition process using the cold spray process is performed in the non-oxidizing gas atmosphere. As a comparative example, it is supposed that the layer deposition process by cold spraying is performed in the air atmosphere as in the prior art. In such a comparative example, oxide formed during the layer deposition process came out by the heat treatment, and generation of cracks in the formed layer was observed. Such cracks in the formed layer reduce adhesion strength of the formed layer.

On the other hand, according to the present embodiment, since the layer deposition process is performed in the non-oxidizing gas atmosphere, oxidization during the layer deposition process is prevented. As a result, the generation of the cracks in the formed layer is prevented. This result has been confirmed through experiments by the inventors of this application. The fact that the generation of the cracks is prevented refers to the fact that the formed layer becomes dense and the adhesion strength of the formed layer increases. Since the separation limit line depends on the adhesion strength and residual stress of the formed layer, the separation limit line is raised as the adhesion strength increases.

Figure 4:
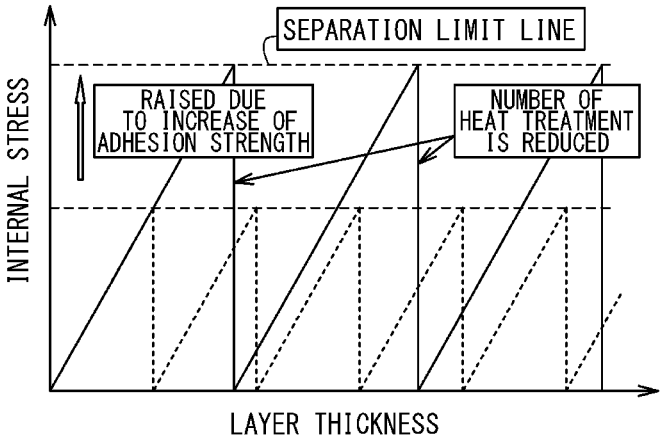
FIG. 4 is a schematic diagram for explaining an effect of the first embodiment.

As shown in FIG. 4, if the separation limit line is raised, a formable thickness by one unit deposition process is increased. Therefore, the number of repetitions of the unit deposition process required to obtain the predetermined layer thickness is reduced. In other words, the number of heat treatment to be performed is reduced. As a result, layer deposition costs are reduced.

As the predetermined layer thickness (desired layer thickness) is increased, the number of repetitions of the unit deposition process is likely to be increased. Therefore, as the predetermined layer thickness is increased, it can be said that applying the present embodiment becomes more preferable.

In addition, in the case of the structure such as a rocket engine combustion chamber, the generation of the cracks becomes a problem from the viewpoint of reliability. From this viewpoint, the present embodiment, in which the generation of cracks can be suppressed, is suitable for depositing a thicker layer of metal on the structure.

2. Second Embodiment

According to the above-described first embodiment, the atmosphere in the chamber 2 is set to the non-oxidizing gas atmosphere. However, as long as the oxidation is suppressed, the atmosphere is not limited thereto. In the second embodiment, in place of the non-oxidizing gas atmosphere, a vacuum atmosphere is used. In this case, the atmosphere control unit 5 is a pressure reducing unit for making a state in the chamber a vacuum state. The vacuum state is, for example, a state in which the pressure is $1\times10^{-3}$ Pa or less.

Figure 5:
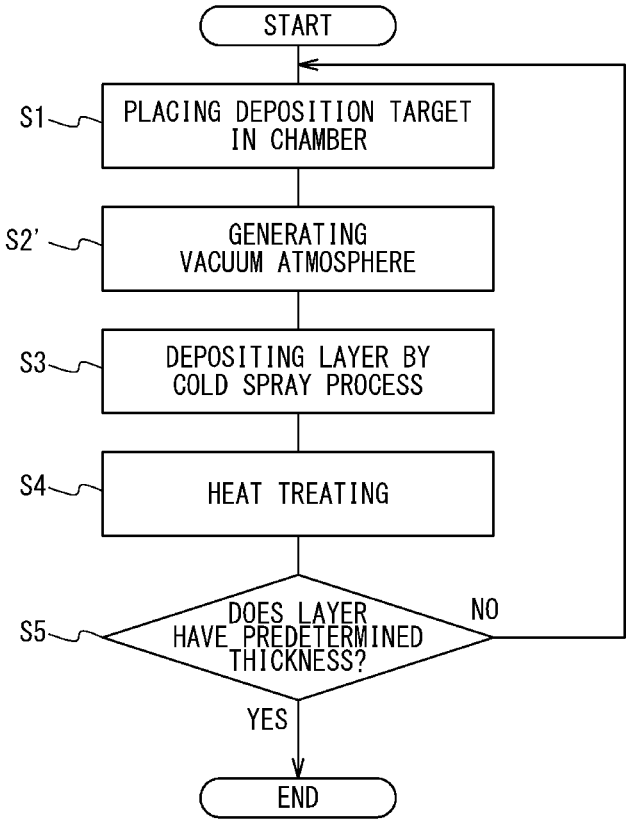
FIG. 5 is a flowchart for indicating the layer deposition method according to the second embodiment.

FIG. 5 is the flowchart for indicating the layer deposition method according to the second embodiment. In the second embodiment, instead of above-described Step S2, Step S2' is performed. In Step S2', the atmosphere control unit 5 is activated to set the atmosphere in the chamber 2 to the vacuum atmosphere. The rest is the same as the first embodiment.

According to the second embodiment, the same effect can be obtained as the first embodiment.

3. Third Embodiment

Figure 6:
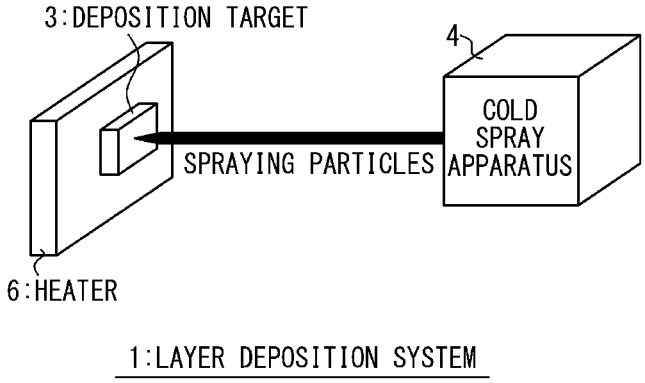
FIG. 6 is a schematic diagram for indicating a configuration of the layer deposition system according to the third embodiment.

FIG. 6 schematically indicates the configuration of the layer deposition system 1 according to the third embodiment. The layer deposition system 1 includes the cold spray apparatus 4 and a heater 6. The heater 6 is disposed to be able to heat the deposition target 3, and typically is arranged so as to contact the deposition target 3. The cold spray apparatus 4 is disposed so as to be able to perform the layer deposition on the deposition target 3 by the cold spray process.

Figure 7:
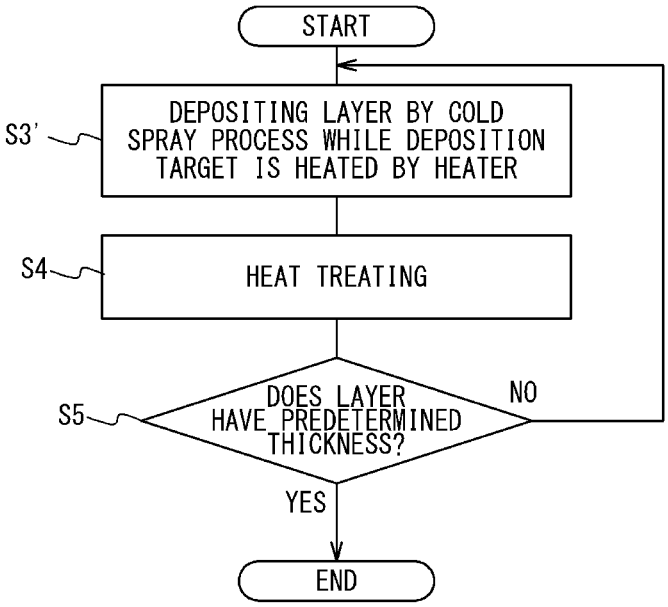
FIG. 7 is a flowchart for indicating the layer deposition method according to the third embodiment.

FIG. 7 is the flowchart for indicating the layer deposition method according to the third embodiment. Referring to FIG. 6 and FIG. 7, the layer deposition method according to the third embodiment will be explained. Note that explanations that are duplicative of those provided with respect to the first embodiment are appropriately omitted.

Step S3':

The heater 6 is activated, and heats the deposition target 3. As a result, the temperature of the deposition target 3 becomes higher than room temperature. Then, in this state, the cold spray apparatus 4 is activated, and the layer deposition on the deposition target 3 is performed by the cold spray process. In other words, the layer deposition on the deposition target 3 is performed while the deposition target 3 is heated by the heater 6. The conditions for cold spraying are the same as those of the first embodiment.

Step S4:

After the layer deposition process of one time is completed, the heat treatment is performed on the deposition target 3, as in the first embodiment. As a result, the residual stress of the formed layer is removed.

Step S5:

The above-mentioned Steps S3' and S4 correspond to the "unit deposition process". When one unit of the deposition process is completed, unless the thickness of the formed layer reaches the predetermined layer thickness (Step S5; No), it returns to Step S3'. On the other hand, if the thickness of the formed layer reaches the predetermined layer thickness (Step S5; Yes), the whole process ends. That is, until the thickness of the formed layer on the deposition target 3 reaches the predetermined layer thickness, the unit deposition process is repeatedly performed.

In the case in which the manufacture of the structure rather than just the coat is considered, the predetermined layer thickness is typically 1 mm or more. In the case of manufacturing the rocket engine combustion chamber, the predetermined layer thickness is typically 10 mm or more. Even when such a thick layer is considered, it is possible to deposit the layer using the cold spray process by performing the heat treatment to remove the residual stress.

As explained above, according to the present embodiment, the layer deposition process using the cold spray process is performed while the deposition target 3 is heated by the heater 6. Effects of this method will be explained with reference to FIG. 8.

As a comparative example, it is supposed that the layer deposition process by cold spraying at room temperature as in the prior art is performed. In the case of such a comparative example, occurrence of the separation at a boundary between the deposition target 3 and the formed layer has been often observed. That is, in many cases, it has been observed that the separation of the formed layer is initiated from the side closest to the deposition target 3. For that reason, the inventors of this application consider the following.

The cold spray process is a process in which the layer deposition is performed by impinging the material powder on an exposed surface. Due to such nature, the exposed surface is heated more and more (surface temperature reaches about 200 degrees Celsius) as the deposition process is repeated. That is, as the deposition layer becomes thicker, a new layer is formed in a state in which the exposed surface is heated more. On the other hand, in an early stage of the layer deposition, the new layer is formed at about room temperature. The inventors of the present application have thought that the temperature difference at the layer deposition affects the adhesion strength of the formed layer. That is, the inventors have thought that, in the side closest to the deposition target 3, since the temperature at the time of deposition is about room temperature, the adhesion strength of the formed layer is low, and the separation is likely to occur.

Figure 8:
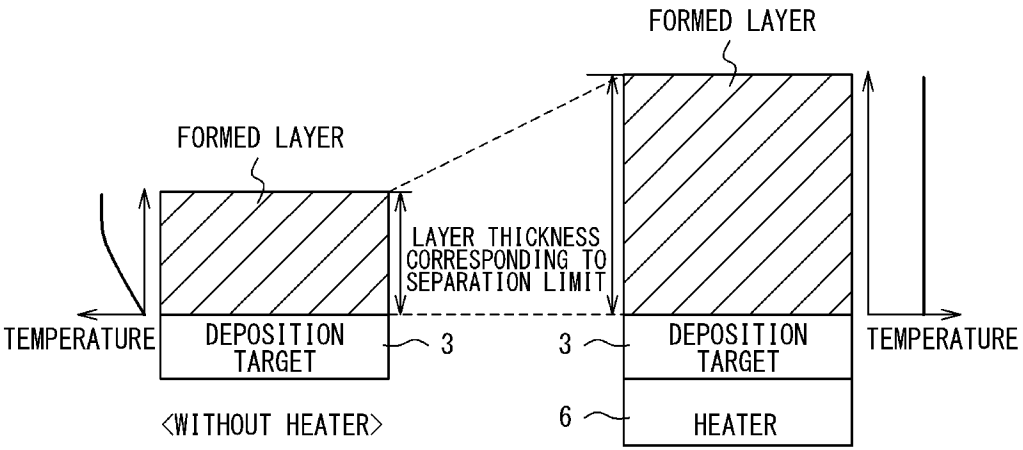
FIG. 8 is a schematic diagram for explaining an effect of the third embodiment.

Therefore, in the present embodiment, the deposition target 3 is "positively" heated using the heater 6 and the heating temperature is set higher than room temperature. The heating temperature is, for example, set at about 200 degrees Celsius, that is a temperature of the surface achievable by cold spraying. Thereby, even in the early stage of the layer deposition, a layer depositing surface becomes sufficiently hot. It is considered that this heating encourages diffusion of atoms, and the adhesion strength of the formed layer is improved. Indeed, as shown in FIG. 8, it was confirmed by experiments performed by the inventors of this application that the layer thickness corresponding to the separation limit was remarkably increased by the method according to the present embodiment.

Thus, according to the present embodiment, the adhesion strength is increased, and, thereby, the separation limit line is also raised. Therefore, as in the first embodiment, the number of the repetitions of the unit deposition process required to obtain the predetermined layer thickness is decreased (see FIG. 4). In other words, the number of the heat treatment to be performed is reduced. As a result, the layer deposition costs are reduced.

As the predetermined layer thickness (desired layer thickness) is increased, the number of repetitions of the unit deposition process is likely to be increased. Therefore, as the predetermined layer thickness is increased, it can be said that applying the present embodiment becomes more preferable.

4. Fourth Embodiment

The fourth embodiment is a combination of the first or second embodiment and the third embodiment.

Figure 9:
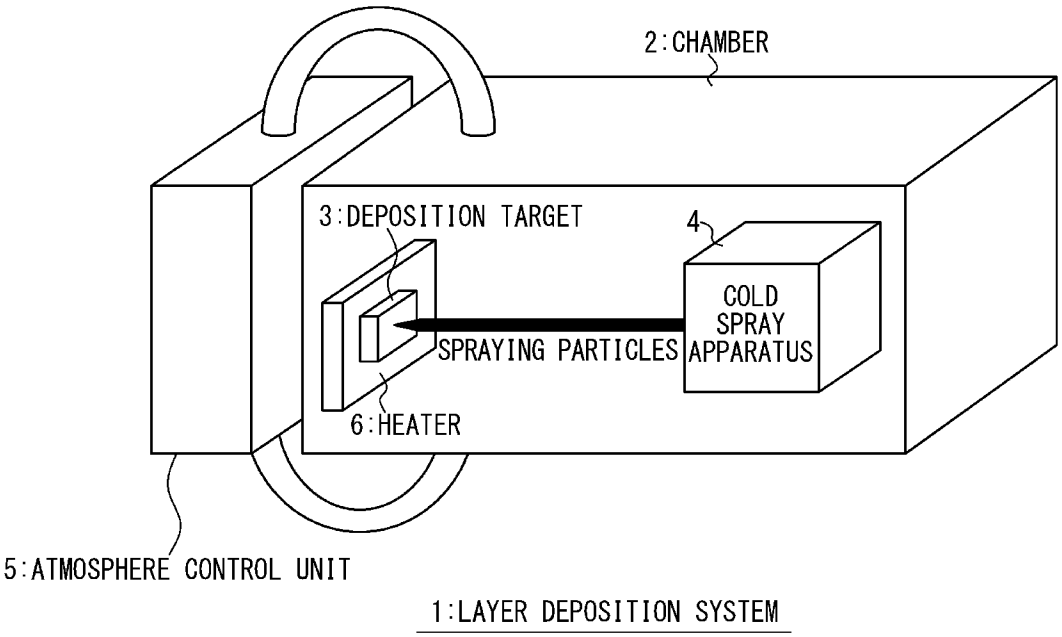
FIG. 9 is a schematic diagram for indicating a configuration of the layer deposition system according to the fourth embodiment.

FIG. 9 schematically indicates the configuration of the layer deposition system 1 according to the fourth embodiment. The layer deposition system 1 includes the heater 6 indicated in FIG. 6 in addition to the configuration indicated in above-explained FIG. 2.

Figure 10:
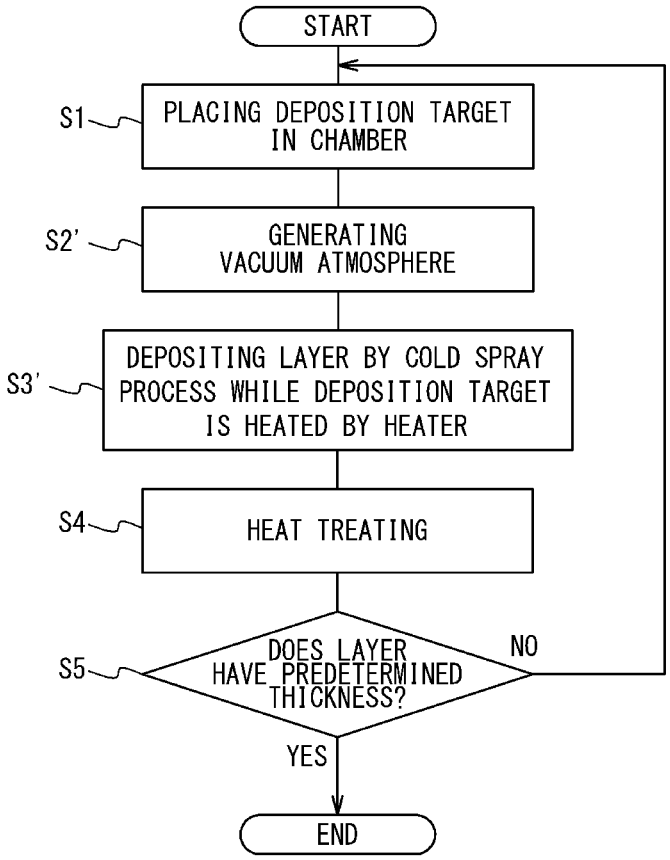
FIG. 10 is a flowchart for indicating the layer deposition method according to the fourth embodiment.

FIG. 10 is the flowchart for indicating the layer deposition method according to the fourth embodiment. In the flowchart, Step S3 of the layer deposition method indicated in FIG. 3 (the first embodiment) or FIG. 5 (the second embodiment) is replaced by Step S3' in the third embodiment.

According to the fourth embodiment, the effect of the combination of the first or second embodiment and the third embodiment can be obtained. Further increase of the adhesion strength of the formed layer is expected, and it is preferable.

5. Fifth Embodiment

As an example, a case in which the layer deposition method according to above-described embodiments is applied to the manufacture of the rocket engine combustion chamber will be considered. Note that, a prior application (Japanese Patent Application Publication JP 2012-057203 A) by the applicant of this application can be referred to.

Figure 11:
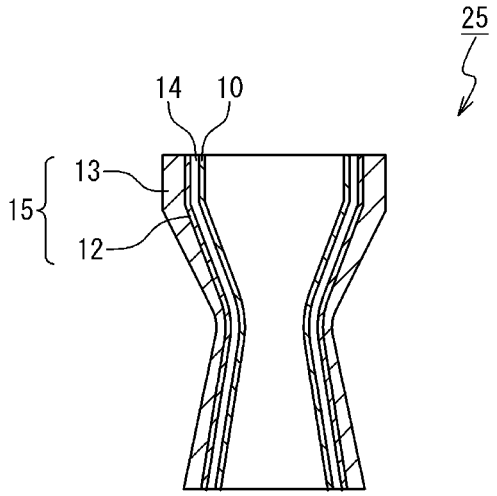
FIG. 11 is a schematic cross-sectional view for indicating a configuration of a rocket engine combustion chamber according to the fifth embodiment.

FIG. 11 schematically indicates the rocket engine combustion chamber 25. In this combustion chamber 25, high-temperature and high-pressure fluid is burned and passed through at the time of use. Furthermore, the combustion chamber 25 has a plurality of cooling passages 14 through which refrigerant passes, and it is possible to suppress the temperature of the combustion chamber 25 by cooling due to the refrigerant. More specifically, the combustion chamber 25 has an inner cylinder 10 and an outer cylinder 15 which are arranged concentrically, and the cooling passages 14 are formed between the inner cylinder 10 and the outer cylinder 15. Note that, as material of the inner cylinder 10 and outer cylinder 15, copper or a copper-based alloy which is mainly composed of copper is preferable from the viewpoint of cooling efficiency, strength or elongation.

Figure 12:
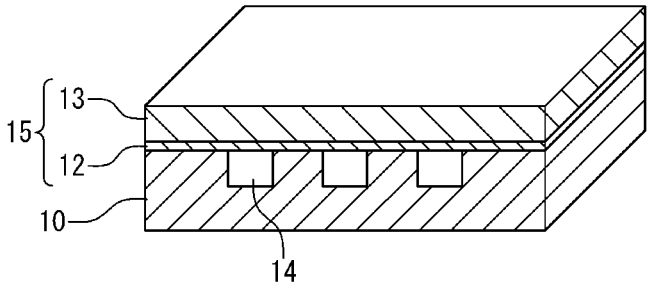
FIG. 12 is a schematic diagram for indicating the configuration of the rocket engine combustion chamber according to the fifth embodiment.

FIG. 12 illustrates the relationship among the inner cylinder 10, the cooling passages 14 and the outer cylinder 15. In the inner cylinder 10, the cooling passages 14 are formed. The inner cylinder 10 serves as a base member, and the outer cylinder 15 is formed thereon. More specifically, the outer cylinder 15 has a laminated structure constituted by a first layer 12 and a second layer 13. The first layer 12 is formed on an inner cylinder 10 side, on the inner cylinder 10 and in a layer form. The second layer 13 is formed on an outer surface of the first layer 12 and in a layer form.

The manufacturing method of the "structure" indicated in FIG. 12 is as follows. At first, grooves are formed in the surface of the inner cylinder 10 which serves as a base member portion. The grooves are to be the fluid flow passages 14 eventually. Subsequently, filler such as wax is filled in the grooves. Note that the filler is filled in such that its exposed surface and a surface of the base member portion (exposed surface of the base member portion) substantially form a single plane.

Next, a conductive layer such as a silver powder layer is formed on the exposed surface of the filler and inner cylinder 10 (base member portion). That is, a conductive treatment is performed in a region where an electroplating layer is to be formed in an electroplating process. Then, by electroplating, the first layer 12 as the electroplating layer is formed on the surface of the filler and inner cylinder 10 on which the conductive treatment is performed.

Then, by the method explained in the above-described embodiment, the second layer 13 as a cold spray layer is formed on the first layer 12. For example, the cold spray layer of copper having a thickness of about 10 mm is deposited. Total thickness of the first layer 12 and the second layer 13 is set to be a desired layer thickness of the outer cylinder 15.

After that, the filler is removed from the grooves by a method such as melting. Thereby, it is possible to manufacture the structure having the plurality of cooling passages 14 surrounded by the outer cylinder 15 and the inner cylinder 10.

Thus, in the present embodiment, the outer cylinder 15 is deposited as the deposition layer by applying a combination of the electroplating process and the cold spray process. Note that, a deposition rate by the cold spray process is extremely fast as compared to a deposition rate by the electroplating process. Therefore, in the case in which the outer cylinder 15, which is the layer (for example, the copper layer), is deposited by applying the combination of the electroplating process and the cold spray process, it is possible to complete the layer deposition in a remarkably short time as compared to the case in which the layer deposition is performed by only electroplating. Thereby, it is possible to shorten the manufacturing period of the structure, while maintaining mechanical properties such as strength and elongation of the layer.

In addition, in the case in which the first layer 12 is formed by the electroplating process and the second layer 13 is formed by the cold spray process, respectively, it is preferable that the first layer 12 is formed relatively thin and the second layer 13 is formed relatively thick. Thereby, it is possible to shorten the manufacturing period and reduce the manufacturing costs and manufacturing labors.

As mentioned above, some embodiments have been explained with reference to the attached drawings. However, the present invention is not limited to the above-mentioned embodiments, and may be appropriately modified by those skilled in the art without departing from the spirit or scope of the general inventive concept thereof.

The invention claimed is:

1. A method for depositing a layer comprising:

performing a unit deposition process to a deposition target for a predetermined thickness; and repeating the performing the unit deposition process, until the layer on the deposition target reaches a desired thickness, wherein the performing the unit deposition process comprises:

placing the deposition target in a chamber;

providing a non-oxidizing gas atmosphere or a vacuum atmosphere in the chamber;

depositing the layer on the deposition target by a cold spray process in the non-oxidizing gas atmosphere or the vacuum atmosphere; and directly heat treating the deposition target itself after the depositing the layer on the deposition target.

2. The method for depositing the layer according to claim 1, wherein the layer is a metal layer deposited by the cold spray process.

3. The method for depositing the layer according to claim 1, wherein the desired thickness is 1 mm or more.

4. The method for depositing the layer according to claim 1, wherein the desired thickness is 10 mm or more.

5. The method for depositing the layer according to claim 1, further comprising forming grooves in the deposition target before performing the unit deposition process.

* * * * *